United States Patent [19]

Wise et al.

[11] 4,083,813

[45] Apr. 11, 1978

[54] PROCESS FOR MAKING GRANULAR DETERGENT COMPOSITION

[75] Inventors: Rodney Mahlon Wise; Donna M. Derstadt, both of Cincinnati, Ohio

[73] Assignee: The Procter & Gamble Company, Cincinnati, Ohio

[21] Appl. No.: 764,126

[22] Filed: Jan. 31, 1977

Related U.S. Application Data

[63] Continuation-in-part of Ser. No. 728,578, Oct. 1, 1976, abandoned.

[51] Int. Cl.[2] ..... C11D 1/72; C11D 1/84; C11D 11/02

[52] U.S. Cl. ..... 252/526; 252/135; 252/156; 252/545; 252/530; 252/549

[58] Field of Search ..... 252/89, 135, 156, 526, 252/545, 530, 549

[56] References Cited

U.S. PATENT DOCUMENTS

| | | | |
|---|---|---|---|
| 3,351,557 | 11/1967 | Almstead et al. | 252/106 |
| 3,537,993 | 11/1970 | Coward et al. | 252/8.75 |
| 3,619,115 | 11/1971 | Diehl et al. | 8/137 |
| 3,764,568 | 10/1973 | Barbera | 252/526 |
| 3,840,480 | 10/1974 | Barrat et al | 252/545 |
| 3,925,262 | 12/1975 | Laughlin et al. | 252/526 |
| 3,929,678 | 12/1975 | Laughlin et al. | 252/526 |
| 4,000,091 | 12/1976 | Wentler | 252/524 |

FOREIGN PATENT DOCUMENTS

| | | |
|---|---|---|
| 814,987 | 11/1974 | Belgium. |
| 912,396 | 10/1972 | Canada. |
| 1,302,794 | 1/1973 | United Kingdom. |
| 1,331,062 | 9/1973 | United Kingdom. |

*Primary Examiner*—P.E. Willis, Jr.
*Attorney, Agent, or Firm*—Steven J. Goldstein; Robert B. Aylor; Richard C. Witte

[57] ABSTRACT

A process for the preparation of spray-dried granular detergent compositions containing an ethoxylated nonionic surfactant and a zwitterionic surfactant, wherein the degradation of the zwitterionic surfactant during processing is minimized, is disclosed. In the process, the nonionic and zwitterionic components are intimately mixed, in the absence of alkaline components, prior to their addition to an aqueous alkaline crutcher mix, which is formed into detergent granules by spray-drying.

17 Claims, No Drawings

PROCESS FOR MAKING GRANULAR DETERGENT COMPOSITION

CROSS REFERENCE TO RELATED APPLICATION

This application is a continuation-in-part of our copending application for PROCESS FOR MAKING GRANULAR DETERGENT COMPOSITIONS, Ser. No. 728,578, filed Oct. 1, 1976, now abandoned.

BACKGROUND OF THE INVENTION

This invention relates to a process for the production of spray-dried granular alkaline detergent compositions containing, as a surfactant system, an ethoxylated nonionic surfactant and a zwitterionic surfactant, wherein the degradation of the zwitterionic detergent during the crutching and spray-drying of the composition is minimized.

In the preparation of spray-dried detergent granules, an aqueous mixture of the various components of the granules (the crutcher mix) is sprayed or otherwise introduced into what is essentially a drying tower. As the droplets of the crutcher mix proceed through the drying tower, the water is flashed off and solid or semi-porous detergent granules are formed. The advantages of spray-dried detergent granules over granules obtained by simple dry-mixing of the individual ingredients include improved homogeneity and more even dissolving rates for the individual components having the same particle size. That is to say, each granule contains the various ingredients of the composition in the same ratios and proportions introduced into the original crutcher mix. This provides obvious advantages over simple dry-mixed detergent formulations, inasmuch as dry-mixing can result in a lack of homogeneity in the final detergent formulation such that the user is never certain of the composition of any given portion of such products.

It is taught in the art that the incorporation of various zwitterionic surface-active agents, particularly in combination with certain nonionic surface-active agents, in detergent compositions yields detergency benefits. Thus, in U.S. Pat. No. 3,351,557, Almstead et al, issued Nov. 7, 1967, it is taught that built liquid detergent compositions comprising certain nonionic surfactants, zwitterionic sultaine surfactants, a detergency builder salt, a polymeric emulsion stabilizer and water, would provide superior detergency characteristics under a wide variety of conditions, and particularly in cool water washing. Additional detergent compositions including zwitterionic sultaine components are described in British Pat. No. 1,331,062, Pearson et al, issued Sept. 19, 1973 and Belgian Specification 814,987, published Nov. 14, 1974. U.S. Pat. No. 3,929,678, Laughlin et al, issued Dec. 30, 1975, discloses that detergent compositions incorporating specifically defined ethoxylated zwitterionic surfactants, together with cosurfactants, provide exceptionally good clay soil removal characteristics which are relatively insensitive to water hardness level and temperature changes. Additional detergent compositions comprising this type of ethoxylated zwitterionic surfactant are disclosed in U.S. Pat. No. 3,925,262, Laughlin et al, issued Dec. 9, 1975 and U.S. Patent Application Ser. No. 603,837, Laughlin et al, filed Aug. 11, 1975.

The crutching and spray-drying process, while possessing the advantages which are described above, does create a problem with regard to the incorporation into granules of relatively alkalinity-sensitive ingredients, of which zwitterionic surfactants are an example. Although it would clearly be very desirable to add zwitterionic surfactants directly to an alkaline crutcher mix prior to spray-drying, it has been found that such addition results in the loss of the zwitterionic surfactants through degradation into various compounds, such as amines.

The zwitterionic surfactants could, of course, be incorporated into the compositions after spray-drying, for example, by dry-mixing or spraying on, but the necessity of such an extra step in the process is undesirable. In addition, the use of such methods makes it difficult to distribute the component uniformly throughout the granular composition.

It is therefore the object of this invention to provide an improved process for the incorporation of zwitterionic and nonionic surfactants into spray-dried granular detergent compositions.

It is a further object of this invention to provide a process whereby zwitterionic surfactants may be incorporated into an aqueous alkaline crutcher mix and subsequently spray-dried, with minimal loss of the surfactants through degradation.

SUMMARY OF THE INVENTION

According to the present invention there is provided a process for the preparation of a zwitterionic surfactant-containing spray-dried granular alkaline detergent composition, wherein the degradation of the zwitterionic surfactant, by the alkaline components during processing of the composition is minimized, comprising the steps of:

(a) forming a mixture consisting essentially of
  (i) an alkoxylated nonionic surface active agent; and
  (ii) a zwitterionic surface-active agent; in a weight ratio of (i) to (ii) of from about 5:1 to about 1:5, said mixture having a pH of less than about 9 at a concentration of 1% by weight in water;
(b) thoroughly agitating said mixture of (a);
(c) thereafter adding said mixture to an aqueous slurry of an alkaline component or components; and
(d) spray-drying the aqueous slurry formed in steps (a) through (c) inclusive to form detergent granules.

In a preferred embodiment, the nonionic and zwitterionic surface-active agents are thoroughly mixed in step (b) so as to form a uniform gel or an emulsion.

Preferred alkaline components are those selected from the group consisting of: '(a) alkali metal oxides;
(b) alkali metal hydroxides;
(c) alkali metal carbonates;
(d) alkali metal silicates having an $SiO_2$:$M_2O$ molar ratio of from about 1:2 to about 2.5:1, wherein M is sodium or potassium or mixtures thereof; and
(e) mixtures thereof.

The granular detergent compositions produced by the process of the present invention may, in addition to the nonionic, zwitterionic and alkaline components, also include other components normally found in detergent compositions. Examples of such components include detergency builder salts, soil suspending agents, corrosion inhibitors, dyes, fillers, optical brighteners, germicides, pH adjusting agents, enzymes, and the like.

DETAILED DESCRIPTION OF THE INVENTION

The process of the present invention requires an ethoxylated nonionic surface-active component, a zwitterionic surface-active component, an alkaline component and water. The nature of these components and the steps of the process of the present invention will be discussed in detail hereinafter.

Zwitterionic Surface Active Agent

The process of the present invention utilizes a zwitterionic surface-active agent and provides a method for incorporating said agent into a spray-dried granular detergent composition with a minimum loss of the zwitterionic surfactant through degradation. The zwitterionic surfactant may be present in such an amount as is required to achieve satisfactory detergency characteristics in a particular detergent composition formulation. Preferred detergent formulations, for use in the present invention, include those which contain from about 2% to about 30% of the zwitterionic surfactant in the spray-dried granule. Particularly preferred compositions contain from about 4% to about 20% of the zwitterionic surfactant.

Zwitterionic surfactants are those surface-active compounds which contain both positive and negative charge centers in the same molecule, while being electrically neutral. Any such surfactant known in the art is useful in the process of the present invention. Examples of such surfactants are disclosed in U.S. Pat. No. 3,400,148, to Quimby, issued Sept. 3, 1968; U.S. Pat. Nos. 3,668,240 and 3,764,568 to Melvin A. Barbera, issued respectively on June 6, 1972 and Oct. 9, 1973; U.S. Pat. No. 3,332,875, to Kessler; and U.S. Pat. Nos. 3,452,066 and 2,781,390, to Mannheimer, issued respectively June 24, 1969 and Feb. 12, 1957, all of which are incorporated herein by reference.

Zwitterionic surfactants include derivatives of aliphatic quaternary ammonium, phosphonium, and sulfonium compounds in which the aliphatic moieties can be straight or branched chained and wherein one of the aliphatic substituents contains from about 8 to 18 carbon atoms and one contains an anionic water-solubilizing group, e.g., sulfate, sulfonate, carboxylate, etc.

One group of preferred zwitterionic surfactants are the sultaines having the formula

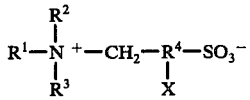

wherein $R^1$ is an alkyl radical containing from 10 to about 18 carbon atoms, $R^2$ and $R^3$ are each selected from the group consisting of methyl, ethyl and hydroxy ethyl radicals, $R^4$ is selected from the group consisting of methylene, ethylene and propylene radicals and X is selected from the group consisting of hydrogen and a hydroxyl group wherein said hydroxyl group is attached only to a secondary carbon atom.

Sultaine zwitterionic surface-active agents of the type described above are disclosed in U.S. Pat. No. 3,351,557, Almstead et al, issued Nov. 7, 1967; U.S. Pat. No. 3,539,521, Snoddy et al, issued Nov. 10, 1970; and U.S. Pat. No. 3,619,115, Diehl et al, issued Nov. 9, 1971, all of which are incorporated herein be reference. Preferred surfactants include those in which $R^4$ is a propylene radical and X is a hydroxyl group. Examples of particularly preferred surfactants of this type include 3-(N,N-dimethyl-N-hexadecylammonio) propane-1-sulfonate, 3-(N,N-dimethyl-N-hexadecylammonio)-2-hydroxy propane-1-sulfonate and 3-(N,N-dimethyl-N-alkyl ammonio)-2-hydroxy propane-1-sulfonate, the alkyl group being derived from middle cut coconut fatty alcohol and higher alkyl or alkaryl ammonio carboxylates, such as (N-dodecylbenzyl-N,N dimethyl ammonio) acetate, (N,N-dimethyl-N-hexadecylammonio) acetate and 6-(N-dodecylbenzyl-N,N-dimethyl ammonio) hexanoate.

Additional highly preferred zwitterionic surfactants include the ethoxylated zwitterionic surfactants of the type described in U.S. Pat. No. 3,925,262, Laughlin et al, issued Dec. 9, 1975; U.S. Pat. No. 3,929,678, Laughlin et al, issued Dec. 30, 1975; U.S. Pat. Application Ser. No. 603,837, Laughlin et al, filed Aug. 11, 1975, all of which are incorporated herein be reference. Particularly preferred ethoxylated zwitterionics of this type are those having the formula

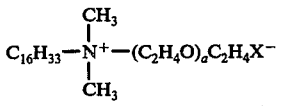

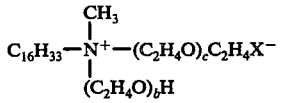

wherein $a$ is from about 5 to 25, the sum of $b + c$ is equal to about 15, and X is $SO_3$ or $SO_4$.

Nonionic Surfactant

The nonionic surface-active agents which are useful in the process of the present invention are alkoxylated nonionic surface-active agents. The alkoxy moiety of the nonionic surfactant is preferably selected from the group consisting of ethylene oxide, propylene oxide and mixtures thereof. Ethylene oxide represents the preferred alkoxy moiety. The alkoxy moiety is condensed with a nonionic base material according to techniques known in the art. All alkoxylated nonionic surfactants which are normally known to be suitable for use in detergent technology can be used herein, examples of such components include:

(1) The condensation product of one mole of a saturated or unsaturated, straight or branched chain carboxylic acid having from about 10 to about 24 carbon atoms with from about 2 to about 2000 moles of ethylene oxide. The acid moiety can consist of mixtures of acid in the above delineated carbon atoms range or it can consist of an acid having a specific number of carbon atoms within this range. The condensation product of one mole of coconut fatty acid having the approximate carbon chain length distribution of 2% $C_{10}$, 66% $C_{12}$, 23% $C_{14}$ and 9% $C_{16}$ with 35 moles of ethylene oxide is a specific example of a nonionic containing a mixture of different chain lengths fatty acid moieties. Other specific examples of nonionics of this type are: the condensation product of one mole of palmitic acid with 40 moles of ethylene oxide; the condensation product of one mole of myristic acid with 35 moles of ethylene oxide; the condensation product of one mole of oleic acid with 45 moles of ethylene oxide; and the condensation product of one mole of stearic acid with 30 moles of ethylene oxide.

(2) The condensation products of one mole of a saturated or unsaturated, straight or branched chain alcohol having from about 10 to about 24 carbon atoms with from about 2 to about 2000 moles of ethylene oxide. The alcohol moiety can consist of mixtures of alcohols in the above-dilineated carbon atom range or it can consist of an alcohol having a specific number of carbon atoms within this range. The condensation product of one mole of coconut alcohol having the approximate chain length distribution of 2% $C_{10}$, 66% $C_{12}$, 23% $C_{14}$ and 9% $C_{16}$ with 45 moles of ethylene oxide ($CNAE_{45}$) is a specific example of a nonionic containing a mixture of different chain length alcohol moieties. Other specific examples of nonionics of this type are the condensation products of one mole of tallow alcohol with from 6 to 20 moles of ethylene oxide; the condensation products of one mole of lauryl alcohol with 35 moles of ethylene oxide; the condensation products of one mole of myristyl alcohol with 30 moles of ethylene oxide; and the condensation products of one mole of oleyl alcohol with 40 moles of ethylene oxide.

(3) Polyethylene glycols having a molecular weight of from about 1400 to about 30,000. For example, Dow Chemical Company manufactures these nonionics in molecular weights of 20,000, 9500, 7500, 4500, 3400 and 1450. All of these nonionics are waxlike solids which melt between 110° F and 200° F.

(4) The condensation products of one mole of alkyl phenol wherein the alkyl chain contains from about 8 to about 18 carbon atoms with from about 4 to about 50 moles of ethylene oxide. Specific examples of these nonionics are the condensation products of one mole of decyl phenol with 40 moles of ethylene oxide; the condensation products of one mole of dodecyl phenol with 35 moles of ethylene oxide; the condensation products of one mole of tetradecyl phenol with 35 moles of ethylene oxide; the condensation products of one mole of hexadecyl phenol with 30 moles of ethylene oxide.

(5) The ethoxylated surfactants disclosed in U.S. Pat. Application Ser. No. 557,217 filed March 10, 1975, inventor Jerome H. Collins, incorporated herein by reference, consisting essentially of a mixture of compounds having at least two levels of ethylene oxide addition and having the formula:

$$R_1 - R_2 - O(CH_2CH_2O)_nH$$

wherein $R_1$ is a linear alkyl residue and $R_2$ has the formula $$-CHR_3CH_2-$$

wherein $R_3$ is selected from the group consisting of hydrogen and mixtures thereof with not more than 40% by weight of lower alkyl, wherein $R_1$ and $R_2$ together form an alkyl residue having a mean chain length in the range of 8–15 carbon atoms, at least 65% by weight of said residue having a chain length within ± 1 carbon atom of the mean, wherein $3.5<n<6.5$, provided that the total amount of components in which $n = 0$ is not greater than 5% by weight and the total amount of components in which $n = 2$–7 inclusive is not less than 63% by weight, and the hydrophilic-lipophilic balance (HLB) of said ethoxylate material is in the range from 9.5–11.5, said surfactant composition being otherwise free of nonionic surfactants having an HLB outside of said range.

Examples of low-foaming alkoxylated nonionic surfactants include the condensation products of benzyl chloride and an ethoxylated alkyl phenol wherein the alkyl group has from about 6 to about 12 carbon atoms and wherein from about 12 to about 20 ethylene oxide molecules have been condensed per molecule of alkyl phenol polyetheresters of the fomula;

$$(ClC_6H_4)_2CHCO_2(CH_2.CH_2.O)_xR$$

wherein $x$ is an integer from 4 to 20 and R is a lower alkyl group containing not more than 4 carbon atoms, for example a component having the formula $$(ClC_6H_4)_2CHCO_2(CH_2CH_2O)_{15}.CH_3;$$

the polyalkoxylation products of alkyl phenol as, for example, the polyglycol alkyl phenol ethers containing an alkyl group having at least 6 and, normally, from about 8 to about 20 carbon atoms and having a molar ratio of ethylene oxide to condensate of about 7.5; 8.5; 11.5; 20.5 and 30; and the acyl-capped, low ethoxy nonionic surfactants described in U.S. Pat. Application Ser. No. 621,456, Williams, filed Oct. 10, 1975, incorporated herein by reference. The alkyl group can, for example, be represented by di-isobutylene; di-amyl, polyermized propylene; iso-octyl; and nonyl.

Additional examples of effective low-foaming nonionics include: the polyoxyalkylene glycol condensates of U.S. Patent 3,048,548, hereby incorporated by reference, having alternating hydrophilic oxyethylene chains and hydrophobic oxypropylene chains wherein the weight of terminal hydrophobic chains, the weight of the middle hydrophobic unit and the weight of the linking hydrophilic units each represent about one-third of the condensate; the de-foaming nonionic surfactants disclosed in U.S. Pat. No. 3,382,178, incorporated herein by reference, having the general formula $$Z[(OR)_nOH]_z$$

wherein Z is alkoxylatable material, R is a radical derived from an alkylene oxide which can be ethylene and propylene and $n$ is an integer from, for example, 10 to 2000 or more and $z$ is an integer determined by the number of reactive oxyalkylatable groups. Z can be represented by normal biodegradable alcohols such as for example octadecanol obtained by reduction of fatty acids derived from coconut oil, palm kernel oil, tallow and also those obtained from petroleum such as for example the mixtures of $C_{10}$ to $C_{18}$ straight-chain primary alcohols; the nonionic surface-active agents of U.S. Pat. No. 3,549,539 being a mixture of nonylphenol-5-EO or the condensation product of a random $C_{11}$ to $C_{15}$ secondary alcohol and ethylene oxide where an HLB value between 11.5 and 13.5; and a polyethylene oxide polypropylene oxide condensate that consists of between 5 and 25% polyethylene oxide and 95 and 75% polypropylene oxide and has a molecular weight between 1500 and 2700; the conjugated polyoxyalkylene compounds described in U.S. Pat. No. 2,677,700, incorporated herein by reference, corresponding to the formula:

$$Y(C_3H_6O)_n(C_2H_4O)_mH$$

wherein Y is the residue of organic compound having from about 1 to 6 carbon atoms and one reactive hydrogen atom, $n$ has an average value of at least about 6.4, as determined by hydroxyl number and $m$ has a value such that the oxyethylene portion constitutes about 10 to 90 weight percent of the molecule; the conjugated polyoxyalkylene compounds described in U.S. Pat. No. 2,674,619, incorporated herein by reference, having the formula:

$$Y[(C_3H_6O)_n(C_2H_4O)_mH]_x$$

wherein Y is the residue of an organic compound having from about 2 to 6 carbon atoms and containing $x$ reactive hydrogen atoms in which $x$ has a value of at least about 2, $n$ has a value such that the molecular weight of the polyoxypropylene hydrophobic base is at least about 900 and $m$ has a value such that the oxyethylene content of the molecule is from about 10 to 90 weight percent. Compounds falling within the scope of the definition for Y include, for example, propylene glycol, glycerine, pentaerythritol, trimethylolpropane, ethylene diamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula:

$$P[(C_3H_6O)_n(C_2H_4O)_mH]_x$$

wherein P is the residue of an organic compound having from about 8 to 18 carbon atoms and containing $x$ reactive hydrogen atoms in which $x$ has a value of 1 or 2, $n$ has a value such that the molecular weight of the polyoxypropylene portion is at least about 58 and $m$ has a value such that the oxyethylene content of the molecule is from about 10 to 90 weight percent and the formula:

$$P[(C_2H_4O)_n(C_3H_6O)_mH]_x$$

wherein P is the residue of an organic compound having from about 8 to 18 carbon atoms and containing $x$ reactive hydrogen atoms in which $x$ has a value of 1 or 2, $n$ has a value such that the molecular weight of the polyoxyethylene portion is at least about 44 and $m$ has a value such that the oxypropylene content of the molecule is from about 10 to 90 weight percent. In either case the oxypropylene chains may contain optionally, but advantageously, small amounts of ethylene oxide and the oxyethylene chains may contain also optionally, but advantageously, small amounts of propylene oxide.

Mixtures of alkoxylated nonionic surfactants are also useful in the present invention.

Referred ethoxylated nonionic surface-active agents are those having the formula $$R(-OCH_2\underset{\underset{CH_3}{|}}{CH})_Y(-OC_2H_4)_ZOH$$

wherein R is selected from the group consisting of alkyl radicals containing from about 8 to about 18 carbon atoms and alkyl phenyl radicals wherein the alkyl groups contain from about 9 to about 15 carbon atoms, wherein Y is an integer from 0 to about 7 and wherein Z is an integer from about 1 to about 45. Particularly preferred nonionic surfactants of this type are those in which R is an alkyl radical containing from about 10 to 16 carbon atoms and $z$ is from about 2 to about 10.

Preferred detergent formulations, which may be made using the process of the present invention, include those which contain, in the spray-dried granule, from about 3 to about 30% of the ethoxylated nonionic surfactant. Particularly preferred compositions contain from about 5 to 20% of the nonionic surfactant.

Alkaline Component

The third essential component for use in the process of the present invention is an alkaline component. It is preferred that sufficient alkaline material be added during the preparation of the detergent composition, such that the final spray-dried detergent granule contains at least about 12% and up to about 50% of the alkaline material.

Any alkaline material normally used in detergent compositions may be used in the process of the present invention. Examples of such alkaline materials include alkali metal oxides, alkali metal hydroxides such as sodium hydroxide (NaOH) and potassium hydroxide (KOH), alkali metal carbonates, such as sodium carbonate, alkali metal silicates having an $SiO_2$:$M_2O$ molar ratio of from about 1:2 to about 2.5:1, wherein M is sodium or potassium or mixtures thereof, the alkaline builders described hereinafter, and mixtures thereof. Preferred alkaline materials for use in the present invention include the alkali metal oxides, hydroxides, carbonates and silicates, defined above, and mixtures thereof. The alkali metal silicates and sodium carbonate are particularly preferred alkaline components for use in the process of the present invention. Particularly preferred sodium silicates are those having an $SiO_2$:$Na_2O$ molar ratio of from 1.6:1 to about 2.4:1.

The detergent compositions prepared by the process of the present invention may also contain other alkaline components which are normally found in such detergent compositions, and which are not incompatible with the operating conditions of the present process. For example, detergent compositions formed by the present process normally include builder salts, especially alkaline, polyvalent anionic builder salts. These alkaline salts serve to maintain the pH of the cleaning solution in the range of from about 7 to about 12, preferably from about 8 to about 11. However, it must again be noted that such alkaline builder salts must be added to the detergent composition in the crutcher mix, and may not be added during the premix stage, in order to obtain the benefits of the present invention. Preferred compositions contain sufficient builder component in the crutcher such that the final detergent granule contains from about 10 to about 60% of the builder material.

Suitable detergent builder salts useful herein can be of the polyvalent inorganic or polyvalent organic types, or mixtures thereof. Nonlimiting examples of suitable water-soluble, inorganic alkaline detergent builder salts include alkali metal carbonates, borates, phosphates, polyphosphates, bicarbonates, silicates, and sulfates. Specific examples of such salts include the sodium and potassium tetraborates, perborates, bicarbonates, carbonates, tripolyphosphates, orthophosphates and hexametaphosphates.

Examples of suitable organic alkaline detergency builder salts are: (1) water-soluble aminopolyacetates, e.g. sodium and potassium ethylene diamine tetraacetates, nitrilotriacetates and N-(2-hydroxyethyl) nitrilodiaceteates; (2) water-soluble salts of phytic acid, e.g., sodium and potassium phytates; (3) water-soluble polyphosphonates, including, sodium, potassium and lithium salts of ethane-1-hydroxy-1,1-diphosphonic acid; sodium, potassium and lithium salts of methylenediphosphonic acid and the like.

Additional organic builder salts useful herein include the polycarboxylate materials described in U.S. Pat. No. 2,264,103, incorporated herein by reference, including the water-soluble alkali metal salts of mellitic acid. The water-soluble salts of polycarboxylate polymers and copolymers, such as are described in U.S. Pat. No. 3,308,067, incorporated herein by reference, are also suitable herein. It is to be understood that while the alkali metal salts of the foregoing inorganic and organic polyvalent anionic builder salts are preferred for use herein, from an economic standpoint, the ammonium, alkanolammonium, e.g. triethanolammonium, diethanolammonium and the like, water-soluble salts of any of the foregoing builder anions are also useful herein.

A further class of detergency builder materials useful in the present invention are insoluble sodium aluminosilicates, particularly those described in Belgian Pat. No. 814,874, issued Nov. 12, 1974 incorporated herein by reference. This patent discloses and claims detergent compositions containing sodium aluminosilicates of the formula $$Na_Z(AlO_2)_Z(SiO_2)_yXH_2O$$

wherein Z and $y$ are integers equal to at least 6, the molar ratio of Z to $y$ is in the range of from 1.0:1 to about 0.5:1 and X is an integer from about 15 to about 264, said aluminosilicates having a calcium ion exchange capacity of at least 200 mg. eq./gram and a calcium ion exchange rate of at least about 2 grains/gallon/minute/gram. A preferred material is $Na_{12}(SiO_2.AlO_2)_{12}.27H_2O$.

Mixtures of organic and/or inorganic builders may be used herein. One such mixture of builders is disclosed in Canadian Pat. No. 755,038, e.g., a ternary mixture of sodium tripolyphosphate, trisodium nitrilotriacetate and trisodium ethane-1-hydroxy-1,1-diphosphonate.

While any of the foregoing alkaline polyvalent builder materials are useful herein, sodium tripolyphosphate, sodium nitrilotriacetate, sodium mellitate, sodium citrate and sodium carbonate are preferred herein for this builder use. Sodium tripolyphosphate is especially preferred herein as a builder both by virtue of its detergency building activity and its ability to suspend illite and kaolinite clay soils and to retard their redeposition on the fabric surface.

Bleaching agents may also be incorporated into the compositions processed by the present invention. Examples of typical bleaching agents are chlorinated trisodiumphosphate and the sodium and potassium salts of dichloroisocyanuric acid.

Additional useful components are those which are added to act as crutcher mix emulsification aids. Examples of such components are the bentonite and kaolinite clays disclosed in U.S. Patent Application Ser. No. 589,116, Wise, filed June 23, 1975, incorporated herein by reference; and the ethylene/maleic anhydride copolymers disclosed in U.S. Pat. No. 3,351,557, Almstead et al, issued Nov. 7, 1967, incorporated herein by reference.

The detergent compositions made by the present process can also contain other adjunct materials commonly used in such compositions. Examples of such components include various soil suspending agents, such as carboxymethylcellulose, corrosion inhibitors, dyes, fillers such as sodium sulfate and silica, optical brighteners, germicides, pH adjusting agents such as mono-, di- or triethanolamine, enzymes and the like.

Processing

The process of the present invention permits the incorporation of zwitterionic surface-active materials into spray-dried alkaline detergent compositions while minimizing the loss of the zwitterionic component through degradation during processing. The first step in the process is the mixing of the alkoxylated nonionic surface-active agent and the zwitterionic surface-active agent described above. These components are mixed together in a weight ratio of nonionic to zwitterionic of from about 5:1 to 1:5, preferably from about 2:1 to about 1:2, most preferably in a ratio of about 1:1. In order to assure the minimum degradation of the zwitterionic component, it is critical that this premixing step be carried out in the absence of the alkaline components of the detergent composition, such that the mixture of the surfactants has a pH of less than about 9, preferably by less than about 7, at a concentration of 1% by weight in water. The nonionic and zwitterionic components are to be completely mixed together, preferably so as to form a uniform gel or an emulsion.

Although not wishing to be bound by theory, it is believed that this premixing of the nonionic and zwitterionic components forms a stabilized, electrolyte-free mesomorphic phase, such that when this mesomorphic phase is added to the crutcher, the zwitterionic component is protected from the alkalinity in the crutcher mix, thereby reducing the degradation of the zwitterionic.

The premix phase is then added to the aqueous crutcher mix which contains the alkaline component or components described above. The crutcher mix contains from about 25% to about 60%, preferably 30 to 40%, of water. Preferred compositions contain sufficient amounts of the nonionic/zwitterionic mixture such that the final spray-dried granules contain at least about 8% of the surfactant mixture, preferably in the range from about 15% to about 40%, most preferably from about 12% to about 25%. It is also preferred that the pH of the crutcher mix be greater than about 9 in a range from about 9 to about 13, at a concentration of about 1% by weight in water, and it is particularly preferred that the pH of the crutcher mix be in the range from about 9.5 to about 11.5.

The crutcher mix is generally prepared at a temperature of 140° F to 180° F and the hot mix is sprayed into a spray-drying tower to contact hot drying air so as to provide a spray-dried granular detergent composition. The spray-drying part of this process is conventional and may be carried out in counter-current or cocurrent drying towers. In its simplest aspect the products of the present invention are spray-dried by pumping the aqueous slurry which has been crutched to the spray-drying tower where the slurry is discharged through a series of atomizing nozzles in a direction opposite to the flow of hot drying gases. The temperature of the hot drying gases in the spray-drying tower should be in the range of from about 150° to about 1,000° F preferably from about 200° to about 800° F, and most preferably from about 220° to about 700° F.

The product may also be spray-dried using a multilevel spray-drying apparatus, such as those described in U.S. Pat. Nos. 3,629,951 and 3,629,955, both issued to Robert P. Davis et al, December 28, 1971, incorporated herein by reference.

This spray-drying process results in detergent granules which contain the nonionic/zwitterionic surfactant system, and which exhibit a minimum amount of degradation of the zwitterionic component. It has also been found that by using the premix process of the present invention, gelling and viscosity increase, which frequently occur in the crutcher, are reduced and/or greatly delayed, thereby eliminating many pumping, atomization and drying problems.

The following nonlimiting examples illustrate the process of the present invention.

EXAMPLE I

Granular detergent compositions having the following composition were formulated.

| Component | % (by weight) |
|---|---|
| Sodium silicate (2.0R) | 20.0 |
| Sodium sulfate | 17.4 |
| $C_{14.8}$ dimethylhydroxy ammonio propane sulfonate | 9.5 |
| Nonionic surfactant (Neodol 45-7 or Neodol 23-3T) | 10.5 |
| Bentonite clay | 3.5 |
| Sodium pyrophosphate | 26.2 |
| Brighteners | 0.9 |
| Moisture | 6.0 |
| Crantrez AN119[1] (15% solution) | 2.0 |
| Minors | 4.0 |

[1]a methyl vinyl ether/maleic anhydride copolymer, added as a crutcher mix emulsification aid.

Some of the compositions were formulated using Neodol 45-7 (the condensation product of 7 moles of ethylene oxide with $C_{14}$–$C_{15}$ aliphatic alcohol) as the nonionic component, and some of the compositions were formulated using Neodol 23-3T (the condensation product of 3 moles of ethylene oxide with $C_{12}$–$C_{13}$ alcohol, stripped so as to eliminate the lower ethoxylate fractions) as the nonionic component. Compositions of type A were formulated in a conventional manner, adding all of the components, together with additional water for slurrying, into the crutcher mix with no premixing of the nonionic and zwitterionic components. Compositions of type B were formulated using the method of the present invention, by premixing the zwitterionic and nonionic components in the absence of alkalinity prior to their addition to the crutcher mix. The premix of the nonionic and zwitterionic components was thoroughly aggitated to form a uniform gel which had a pH of about 8 at a concentration of 1% by weight in water. The premix was then added to the alkaline crutcher mix which contained about 35% by weight of water and had a pH of about 11 at a concentration of 1% by weight in water, as did the crutcher mixes of type A. Both crutcher mixes A and B were then spray-dried using 10′ and 5′ diameter spray-drying towers, to form detergent granules.

The granules so formed were analyzed so as to determine the percentage of the zwitterionic component contained in them, and that percentage was compared with the amount of the zwitterionic component in the original crutcher formulation. The difference in the percentage of zwitterionic in the final granule compared with the amount originally added to the crutcher mix is indicative of the amount of zwitterionic which was lost by decomposition during the processing of the granule. The runs were completed and averages of the runs are reported in the table below.

| | Zwitterionic in Granule (as % of that added to Crutcher) | | |
|---|---|---|---|
| Composition | 10′ Tower | 5′ Tower | Overall Average |
| A | 45% | 82% | 64% |
| B | 73% | 98% | 81% |

The data indicate a substantial decline in the amount of zwitterionic surfactant lost during processing when the process of the present invention was used, in comparison with conventional crutching and spray-drying processes. It was also noted that the crutcher mixes, where the nonionic and zwitterionic components had been premixed prior to addition, were less viscous and therefore exhibited fewer problems with regard to pumping or atomization in the spray-drying process.

Substantially similar results are achieved when the zwitterionic component used in the above compositions is replaced by 3-(N,N-dimethyl N-hexadecylammonio) propane-1-sulphonate, 3-(N,N-dimethyl-N-hexadecylammonio)-2-hydroxy propane-1-sulfonate, or an ethoxylated zwitterionic surfactant having the formula $$C_{16}H_{33}-{}^{+}\underset{\underset{CH_3}{|}}{\overset{\overset{CH_3}{|}}{N}}-(C_2H_4O)_9-C_2H_4SO_4^{-}$$

Similar results are also obtained where the nonionic surface-active agents of the above compositions are replaced by the condensation product of about 9.5 moles of ethylene oxide per mole of nonyl phenol, the condensation product of about 12 moles of ethylene oxide per mole of dodecyl phenol, the condensation product of about 15 moles of ethylene oxide per mole of diisooctylphenol, the condensation product of myristyl alcohol with about 10 moles of ethylene oxide, the condensation of product of about 9 moles of ethylene oxide per mole of coconut alcohol, and nonionic surfactants having the formula $$R(-OCH_2\underset{\underset{CH_3}{|}}{CH})_Y(-OC_2H_4)_ZOH$$

wherein R is a $C_{10}$–$C_{16}$ alkyl group, Y is equal to from 0 to 7 and Z is equal to from 2 to 10.

Comparable results are also obtained where the sodium silicate alkaline component of the above compositions is replaced by sodium carbonate, sodium oxide, potassium oxide, sodium hydroxide, potassium hydroxide, or potassium silicate.

EXAMPLE II

A granular detergent composition, having the following formula, is made using the process of the present invention, by first premixing the nonionic and zwitterionic components and then adding this premix to the crutcher mix.

The premix of the nonionic and zwitterionic components has a pH of about 7.0, at a concentration of 1% by weight in water, and is thoroughly agitated so as to form a uniform gel. The premix is then added to the aqueous crutcher mix containing the remaining components of the composition. The crutcher mix contains about 30% by weight of water and has a pH of about 10.5 at a concentration of 1% by weight in water. Finally, the crutcher mix is spray-dried to form detergent granules.

| Component | % (by weight) |
|---|---|
| Dobanol 45-E-7[1] | 6 |
| $C_{16}H_{33}-\underset{\underset{CH_3}{\vert}}{\overset{\overset{CH_3}{\vert}}{N}}-(C_2H_4O)_9-C_2H_4SO_4^-$ | 6 |
| Sodium tripolyphosphate | 28 |
| Sodium carboxymethylcellulose | 0.5 |
| Sodium silicate | 15 |
| Sodium sulfate | 10 |
| Sodium perborate (dry mixed with the detergent granules after they are spray-dried) | 18 |
| Shell 185/190[2] | 5 |
| Moisture | 10 |
| Minors | balance to 100% |

[1]a branched-chain alcohol ethoxylate available from Shell, having an average alcohol chain length of $C_{14-15}$ and an average ethoxylation of 7.
[2]a microcrystaline wax suds suppressor available from Shell

EXAMPLE III

A granular detergent composition, having the following formula, is made using the process of the present invention.

| Component | % (by weight) |
|---|---|
| Sodium sulfonated a hexadecene | 10 |
| Condensation product of a $C_{12}$ alcohol with 7 moles of ethylene oxide | 15 |
| 3-(N,N-dimethyl-N-dodecylammonio) 2-hydroxy propane 1-sulfonate | 15 |
| Sodium carbonate | 15 |
| Builder mixture comprising on a molar basis: 40% ethane-1-hydroxy-1, 1-diphosphonic acid 30% nitrilotriacetate 30% sodium tripolyphosphate | 45 |

The zwitterionic and nonionic components, described above, are combined and are thoroughly agitated together to form a uniform gel. The mixture has a pH of about 6.5 at a concentration of 1% by weight in water. This premixture is then added to the aqueous alkaline crutcher mix, which has a pH of about 11 at a concentration of 1% by weight in water, containing the remaining components described above together with about 40% by weight of water, and detergent granules are formed by spray-drying the crutcher mix, using a 10' diameter drying tower and drying gases having a temperature of about 600° F.

The resulting granular composition exhibits less zwitterionic degradation during processing than would be present using conventional processing methods.

What is claimed is:

1. A process for preparing a zwitterionic surfactant-containing spray-dried granular alkaline detergent composition, wherein the degradation of the zwitterionic surfactant by the alkaline components is minimized, comprising the steps of:
   (a) Forming a mixture consisting essentially of
      (i) an alkoxylated nonionic surface-active agent; and
      (ii) a zwitterionic surface-active agent; in a weight ratio of (i) to (ii) of from about 5:1 to about 1:5 said mixture having a pH of less than about 9 at a concentration of 1% by weight in water;
   (b) thoroughly agitating said mixture of (a);
   (c) thereafter adding said mixture to an alkaline aqueous slurry of an alkaline component or components; and
   (d) spray-drying the aqueous slurry formed in steps (a)-(c) inclusive to form detergent granules.

2. A process according to claim 1 wherein the mixture of zwitterionic and nonionic has a pH of less than about 7 at a concentration of 1% by weight in water.

3. A process according to claim 2 wherein the alkaline component is selected from the group consisting of:
   (a) an alkali metal oxide;
   (b) an alkali metal hydroxide;
   (c) an alkali metal carbonate;
   (d) an alkali metal silicate having an $SiO_2$:$M_2O$ molar ratio of from about 1:2 to about 2.5:1 wherein M is sodium or potassium or mixtures thereof; and
   (e) mixtures thereof.

4. A process according to claim 3 wherein the nonionic surface-active agent has the formula $$R(-OCH_2\underset{\underset{CH_3}{\vert}}{CH})_Y(-OC_2H_4)_ZOH$$

wherein R is selected from the group consisting of alkyl radicals containing from about 8 to about 18 carbon atoms and alkyl phenyl radicals wherein the alkyl groups contain from about 9 to about 15 carbon atoms, wherein Y is an integer from 0 to about 7 and wherein Z is an integer from about 1 to about 45.

5. A process according to claim 4 wherein the zwitterionic surfactant is one selected from the group consisting of $$C_{16}H_{33}-\underset{\underset{CH_3}{\vert}}{\overset{\overset{CH_3}{\vert}}{N^+}}-(C_2H_4O)_aC_2H_4X^- \quad (a)$$

$$C_{16}H_{33}-\underset{\underset{(C_2H_4O)_bH}{\vert}}{\overset{\overset{CH_3}{\vert}}{N^+}}-(C_2H_4O)_cC_2H_4X^- \quad (b)$$

(c) mixtures thereof; wherein $a$ is from about 5 to 25, the sum of $b + c$ is equal to about 15, and X is $SO_3$ or $SO_4$.

6. A process according to claim 4 wherein the zwitterionic surface-active agent is a sultaine of the formula $$R^1-\underset{\underset{R^3}{\vert}}{\overset{\overset{R^2}{\vert}}{N^+}}-CH_2-\underset{\underset{X}{\vert}}{R^4}-SO_3^-$$

wherein $R^1$ is an alkyl radical containing from about 10 to about 18 carbon atoms, $R^2$ and $R^3$ are each selected from the group consisting of methyl, ethyl, and hydroxyethyl radicals, $R^4$ is selected from the group consisting of methylene, ethylene, and propylene radicals and X is selected from the group consisting of hydrogen and a hydroxyl group wherein said hydroxyl group is attached only to a secondary carbon atom.

7. A process according to claim 6 wherein the weight ratio of ethoxylated nonionic surface-active agent to zwitterionic surface-active agent is from about 2:1 to about 1:2.

8. A process according to claim 7 wherein the mixture of step (a) is thoroughly aggitated so as to form a uniform gel.

9. A process according to claim 8 wherein the aqueous slurry of step (c) has a pH greater than about 9 at a concentration of 1% by weight in water.

10. A process according to claim 9 wherein the aqueous slurry of step (c) has a pH greater than about 9.5 at a concentration of 1% by weight in water.

11. A process according to claim 10 wherein the nonionic surface-active agent is such that R is an alkyl radical containing from about 10 to 16 carbon atoms and Z is from about 2 to about 10.

12. A process according to claim 11 wherein the zwitterionic surface-active agent is such that $R^4$ is a propylene radical and X is a hydroxyl group.

13. A process according to claim 12 wherein the alkaline component is sodium silicate having an $SiO_2$-:$Na_2O$ molar ratio of from about 1.6:1 to about 2.4:1.

14. A process according to claim 13 such that the final spray-dried granules contain at least about 8% by weight of the nonionic/zwitterionic surfactant mixture of step (a).

15. A process according to claim 14 such that the final spray-dried granule contains at least about 12% and not more than about 50% by weight of the alkali metal silicate.

16. A process according to claim 1 such that the final spray-dried granules contain from about 2 to about 30% of said zwitterionic surfactant and from about 3 to about 30% of said alkoxylated nonionic surfactant.

17. A new process according to claim 16 such that the final spray-dried granules contain from about 12 to about 50% of said alkaline component or components.

* * * * *